US010958000B2

(12) United States Patent
Eriksen

(10) Patent No.: US 10,958,000 B2
(45) Date of Patent: Mar. 23, 2021

(54) PRINTBOARD CONTACT GRIP

(71) Applicant: PPC Broadband, Inc., East Syracuse, NY (US)

(72) Inventor: Kim Lundgren Eriksen, Tappernøje (DK)

(73) Assignee: PPC BROADBAND, INC., East Syracuse, NY (US)

( * ) Notice: Subject to any disclaimer, the term of this patent is extended or adjusted under 35 U.S.C. 154(b) by 110 days.

(21) Appl. No.: 16/128,506

(22) Filed: Sep. 11, 2018

(65) Prior Publication Data

US 2020/0083621 A1 Mar. 12, 2020
US 2021/0013645 A9 Jan. 14, 2021

Related U.S. Application Data

(63) Continuation of application No. 15/408,409, filed on Jan. 17, 2017, now Pat. No. 10,074,918.

(60) Provisional application No. 62/279,605, filed on Jan. 15, 2016.

(51) Int. Cl.

| | |
|---|---|
| ***H01R 12/70*** | (2011.01) |
| ***H01R 43/20*** | (2006.01) |
| ***H01R 24/50*** | (2011.01) |
| *H01R 103/00* | (2006.01) |

(52) U.S. Cl.
CPC ..... *H01R 12/7082* (2013.01); *H01R 12/7023* (2013.01); *H01R 24/50* (2013.01); *H01R 43/205* (2013.01); *H01R 2103/00* (2013.01)

(58) Field of Classification Search
CPC ... H01R 12/7023; H01R 24/50; H01R 43/205
USPC ..... 439/65
See application file for complete search history.

(56) References Cited

U.S. PATENT DOCUMENTS

| | | | | |
|---|---|---|---|---|
| 3,879,103 A | | 4/1975 | Peltola et al. | |
| 4,453,796 A | | 6/1984 | Monroe | |
| 4,645,288 A | * | 2/1987 | Stursa | H01R 24/50 439/581 |
| 4,795,352 A | | 1/1989 | Capp et al. | |
| 5,120,258 A | * | 6/1992 | Carlton | H01R 24/50 439/581 |
| 5,326,280 A | | 7/1994 | Briones et al. | |
| 5,413,504 A | | 5/1995 | Kloecker et al. | |
| 5,580,276 A | | 12/1996 | Mussen | |
| 5,647,748 A | | 7/1997 | Mills et al. | |
| 5,738,546 A | | 4/1998 | Burroughs et al. | |

(Continued)

FOREIGN PATENT DOCUMENTS

| | | |
|---|---|---|
| CN | 204333392 U | 5/2015 |
| EP | 2 112 717 A2 | 10/2009 |
| JP | S64-57579 A | 3/1989 |

OTHER PUBLICATIONS

Mar. 23, 2017 International Search Report issued in International Application No. PCT/US2017/013833.

*Primary Examiner* — Peter G Leigh
(74) *Attorney, Agent, or Firm* — MH2 Technology Law Group LLP

(57) ABSTRACT

A printed circuit board connector includes a cable attachment portion configured to be coupled with a cable and a printed circuit board attachment section configured to be coupled with a printed circuit board. The printed circuit board attachment section is configured to be coupled with the printed circuit board via a snap-fit connection.

20 Claims, 2 Drawing Sheets

(56) References Cited

U.S. PATENT DOCUMENTS 5,860,812 A * 1/1999 Gugliotti ..... H01R 24/50 439/63
6,036,545 A 3/2000 Caviness et al.
6,074,218 A 6/2000 Wu et al.
6,081,998 A * 7/2000 Terauchi ..... H05K 3/303 29/842
6,475,033 B1 11/2002 Zhu et al.
6,527,561 B1 * 3/2003 Glauser ..... H01R 24/50 29/828
6,629,857 B1 10/2003 Ma et al.
6,808,395 B2 * 10/2004 Lin ..... H01R 9/0515 439/578
7,563,112 B2 * 7/2009 Honda ..... H01R 43/0256 439/79
7,748,997 B2 * 7/2010 Hamner ..... H01R 12/712 439/607.01
7,841,905 B2 11/2010 Zheng et al.
7,988,455 B2 * 8/2011 Blakborn ..... H01R 13/64 439/63
8,109,790 B2 2/2012 He et al.
8,562,364 B2 * 10/2013 Lin ..... H01R 13/08 439/246
8,636,522 B2 1/2014 Sykes et al.
8,641,447 B2 * 2/2014 Sykes ..... H01R 24/44 439/582
8,727,807 B2 * 5/2014 Sykes ..... H01R 9/0521 439/578
9,386,888 B2 7/2016 Lyons et al.
2003/0092289 A1 * 5/2003 Otsu ..... H01R 24/44 439/63
2006/0234562 A1 10/2006 Lin
2008/0207053 A1 * 8/2008 Lin ..... H01R 12/7023 439/607.01
2009/0137133 A1 * 5/2009 Gou ..... H01R 24/50 439/63
2010/0261357 A1 * 10/2010 Blakborn ..... H01R 13/64 439/63

* cited by examiner

PRINTBOARD CONTACT GRIP

CROSS-REFERENCE TO RELATED APPLICATION

This is a continuation of U.S. application Ser. No. 15/408,409, filed on Jan. 17, 2017, pending, which claims the benefit of U.S. Provisional Application No. 62/279,605, filed on Jan. 15, 2016, the disclosures of which are incorporated herein by reference in their entirety.

BACKGROUND

Printed circuit board (PCB) connectors, for example, F-type connectors, BNC connectors, and the like, can be fixed to a printed circuit board for transmitting TV or CATV signals. Conventional connectors comprise an outer conductor and a center conductor that are soldered to the printed circuit board. The outer conductor typically comprises four corner arms that extend from a housing.

When welding the conventional connectors to the printed circuit board, the connector must be held in position by one hand of the person performing the soldering while the person solders with the other hand. As such, it is difficult to maintain the connector in a correct position with respect to the printed circuit board during soldering.

It is desirable to provide PCB connectors that can be assembled to a printed circuit board before soldering. For example, PCB connectors may include a gripping assembly configured to grip the printed circuit board.

SUMMARY

In accordance with various aspects of the disclosure, a printed circuit board connector includes a cable attachment portion configured to be coupled with a cable and a printed circuit board attachment section configured to be coupled with a printed circuit board. The printed circuit board attachment section is configured to be coupled with the printed circuit board via a snap-fit connection.

In some aspects, the printed circuit board attachment section is configured to couple the connector with electrical ground and signal traces of the printed circuit board.

According to various aspects, the printed circuit board attachment section includes a pin forming a center conductor, and four corner arms forming an outer conductor. In some aspects, the four corner arms and the center conductor are configured to be coupled with the printed circuit board, and the printed circuit board has a hole pattern corresponding with the four corner arms and the center conductor. In various aspects, the printed circuit board includes a center hole configured to receive the center conductor and four outer holes configured to receive the four corner arms.

In accordance with various aspects, the printed circuit board connector includes a body member, and each of the four corner arms includes a first portion having a first end at the body member and extending from the body member to a mount. In some aspects, the mount includes a flange extending from a second end of the first portion in a direction away from the center conductor, and a finger extending from the flange in a direction away from the body member and parallel to the center conductor. The fingers are axially offset from the first portions relative to an axis of the center conductor. According to some aspects, the finger of the mount has an outer surface facing in a direction away from the center conductor, the outer surface includes a notch extending along a length of the finger, the finger includes a tapered free end, and an inner surface of the finger cooperates with a surface of the flange that faces away from the body member to define a shoulder.

According to some aspects, the four corner arms are flexible in a direction toward and away from the center conductor so as to function as a gripping assembly to couple the connector to the printed circuit board. In various aspects, as the four corner arms are inserted into corresponding holes in the printed circuit board, the four corner arms are urged inward in a direction toward the center conductor. According to some aspects, the four corner arms each include a tapered end and a notch adjacent the tapered end, and after the tapered end of each corner arm is inserted through the corresponding hole, the respective flexible corner arm is configured to return to a rest configuration as the notch is aligned with the printed circuit board.

In accordance with some aspects, the printed circuit board attachment section is configured to grip the printed circuit board, via the snap-fit connection, to maintain a desired alignment of the four corner arms and the center conductor relative to a plane of the printed circuit board.

According to various aspects, the printed circuit board connector is one of a straight mount jack and a right angle jack and/or the cable attachment portion is configured as one of an F-type connector and a BNC connector.

In accordance with various aspects of the disclosure, a connector configured to be coupled with a printed board includes a cable attachment portion configured to be coupled with a cable and an attachment section configured to be coupled with the printed board. The attachment section may include a pin forming a center conductor and four corner arms forming an outer conductor. The attachment section is configured to be coupled with the printed board via a snap-fit connection to maintain a desired alignment of the four corner arms and the center conductor relative to a plane of the printed board, and the printed board is one of a printed circuit board and a printed wiring board.

In some aspects, the four corner arms the center conductor are configured to be coupled with the printed board, and the printed board has a hole pattern corresponding with the four corner arms and the center conductor. According to various aspects, the connector may include a body member, and each of the four corner arms may include a first portion having a first end at the body member and extending from the body member to a mount. In various aspects, the mount may include a flange extending from a second end of the first portion in a direction away from the center conductor, and a finger extending from the flange in a direction away from the body member and parallel to the center conductor. The fingers are axially offset from the first portions relative to an axis of the center conductor. In various aspects, the finger of the mount has an outer surface facing in a direction away from the center conductor, the outer surface includes a notch extending along a length of the finger, the finger includes a tapered free end, and an inner surface of the finger cooperates with a surface of the flange that faces away from the body member to define a shoulder.

In accordance with various aspects, the four corner arms are flexible in a direction toward and away from the center conductor so as to function as a gripping assembly to couple the connector to the printed board.

According to some aspects, the four corner arms each include a tapered end and a notch adjacent the tapered end, and, as the four corner arms are inserted into corresponding holes in the printed circuit board, the four corner arms are urged inward in a direction toward the center conductor, and, after the tapered end of each corner arm is inserted through the corresponding hole, the respective flexible corner arm is configured to return to a rest configuration as the notch is aligned with the printed board.

BRIEF DESCRIPTION OF THE DRAWINGS

Exemplary embodiments will be described with reference to the following drawings.

DETAILED DESCRIPTION OF EMBODIMENTS

The detailed description provided below in connection with the appended drawings is intended as a description of the present examples and is not intended to represent the only forms in which the present example may be constructed or utilized. The description sets forth the functions of the example and the sequence of steps for constructing and operating the example. However, the same or equivalent functions and sequences may be accomplished by different examples.

Figure 1:
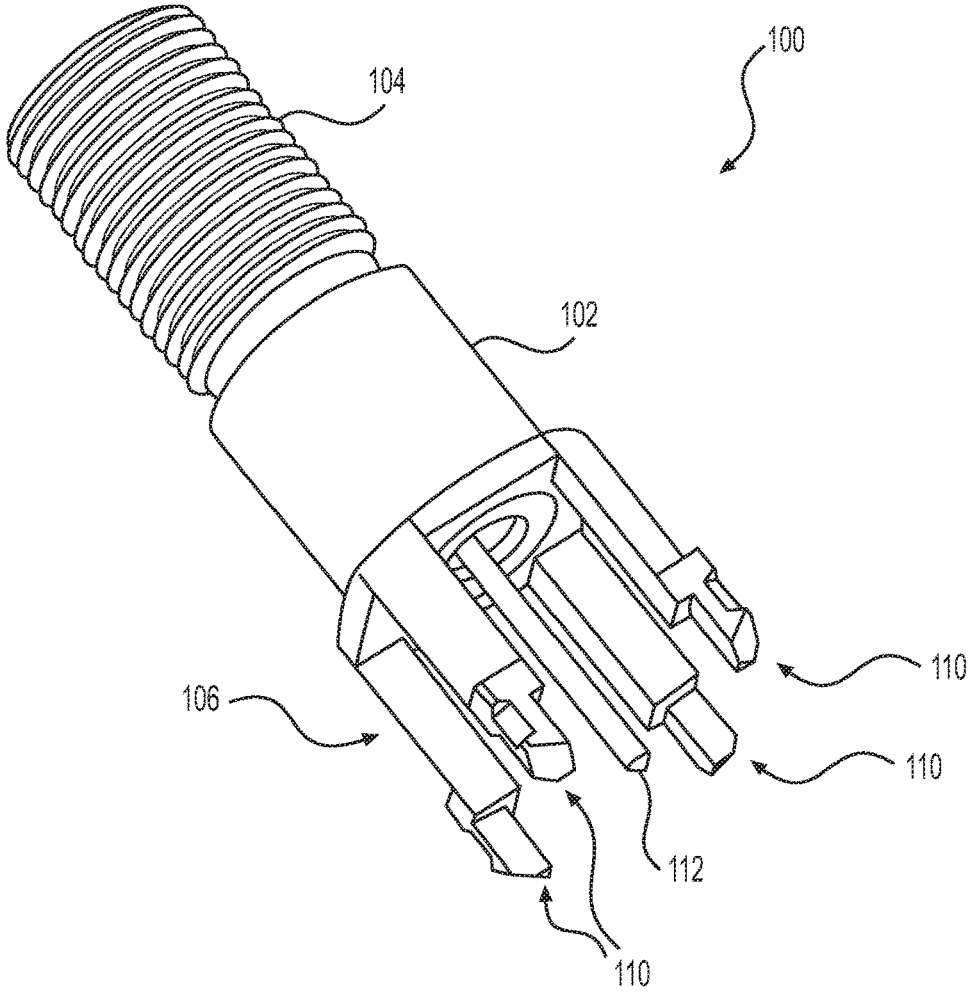
FIG. 1 shows a perspective view of an exemplary connector in accordance with various aspects of the disclosure.

FIG. 1 shows a first example of a PCB connector 100 according to various aspects of the disclosure. The PCB connector illustrated in FIG. 1 is known to those skilled in the art as a "straight PCB mount jack." It should be appreciated that, in some aspects, the connector 100 may be configured as a right angle PCB mount jack.

The connector 100 may include a body member 102, a cable attachment portion 104, and a printed circuit board attachment section 106. The cable attachment portion 104, where an external connection through a mating connector (not shown) may be made, extends from a first end of the body member 102. It should be appreciated that the cable attachment portion 104 may be configured as an F-type connector, a BNC connector, or the like. The printed circuit board attachment section 106 extends from a second end of the body member (e.g., an opposite end or an end disposed at 90° relative to the first end) and couples the connector 100 to the electrical ground and signal traces of a PCB (or alternatively a printed wiring board) upon which the connector 100 is disposed.

The printed circuit board attachment section 106 includes four corner arms 110 forming an outer conductor. The printed circuit board attachment section 106 also includes a center conductor 112 configured as a pin that may be coupled to a PCB trace (not shown). The four corner arms 110 are constructed so as to be flexible in a direction toward and away from the center conductor.

Figure 4:
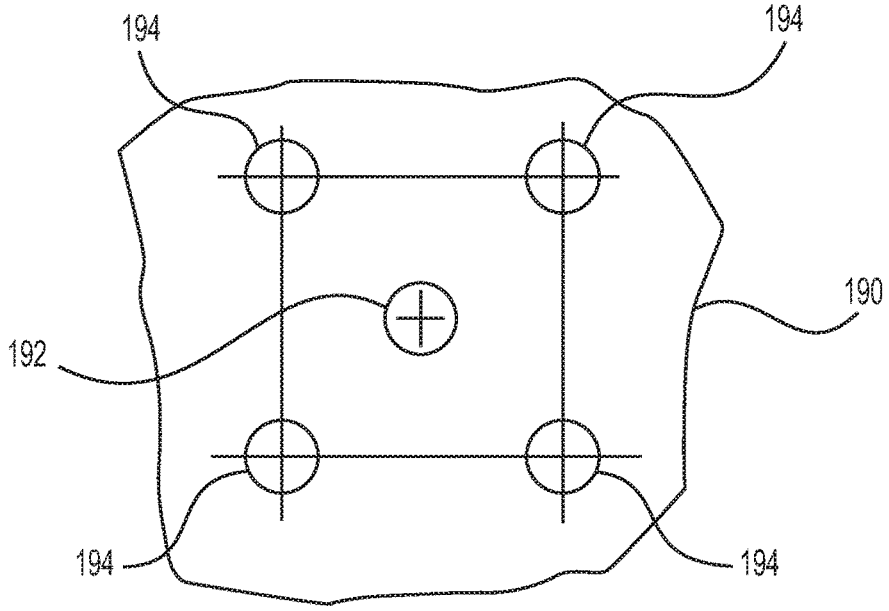
FIG. 4 shows a top view of an exemplary printed circuit board.

The four corner arms 110 and the center conductor 112 are structured and arranged to be coupled with a printed circuit board 190 having a corresponding hole pattern (FIG. 4). As shown in FIG. 4, the PCB may include a center hole 192 configured to receive the center conductor 112 and four outer holes 194 configured to receive the four corner arms 110.

Figure 2:
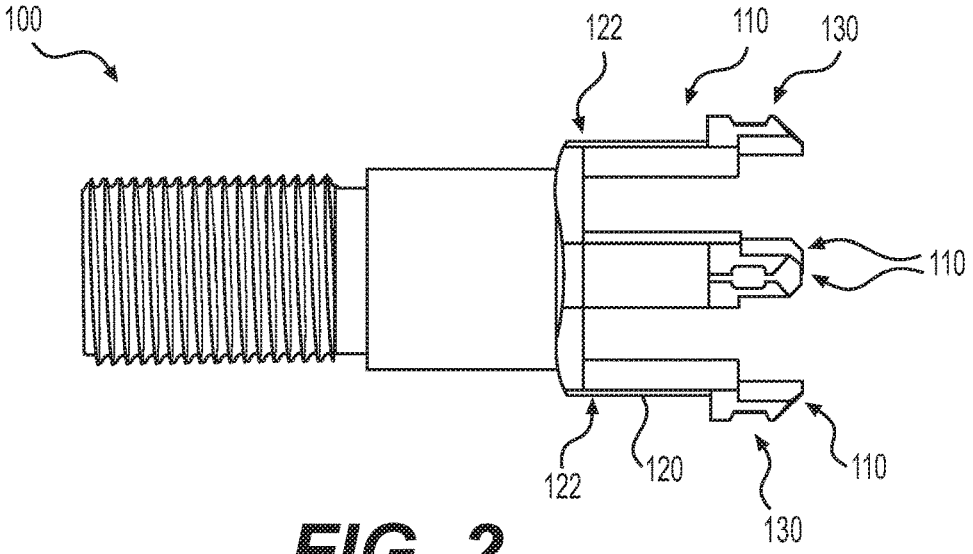
FIG. 2 shows a side view of the exemplary connector of FIG. 1.
Figure 3:
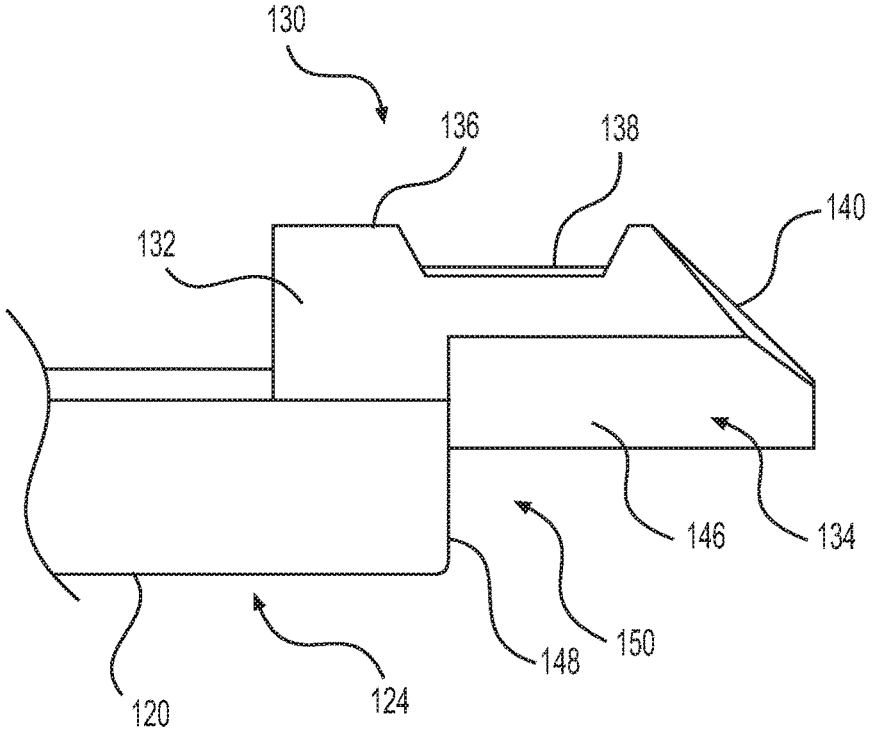
FIG. 3 shows a side view of an exemplary PCB mount of the exemplary connector of FIG. 1.

As best illustrated in FIGS. 2 and 3, each of the four corner arms 110 includes a first portion 120 having a first end 122 at the body member 102 and extending from the body member 102 to a PCB mount 130. The PCB mount 130 includes a flange 132 extending from a second end 124 of the first portion 120 in a direction away from the center conductor 112 and a finger 134 extending from the flange 132 in a direction away from the body member 102 and parallel to the center conductor 112. The fingers 134 are thus axially offset from the first portions 120 relative to an axis of the center conductor 112.

Referring to FIG. 3, the finger 134 of the PCB mount 130 has an outer surface 136 facing in a direction away from the center conductor 112. The outer surface 136 includes a notch 138 extending along a length of the finger 134. The finger 134 includes a tapered free end 140. An inner surface 146 of the finger 134 cooperates with a surface 148 of the flange 132 that faces away from the body member to define a shoulder 150.

In use, the four corner arms 110 of the printed circuit board attachment section 106 may function as a gripping assembly to couple the connector 100 to the PCB 190 before soldering. The center conductor 112 and the four corner arms 110 are aligned with the corresponding holes 194 in the PCB 190. As the four corner arms 110 are inserted into the outer holes 194, the tapered ends 140 of the offset fingers 134 engage the printed circuit board, the flexible corner arms 110 are urged inward in a direction toward the center conductor 112.

After the tapered end 140 of each finger 134 is inserted completely through the corresponding hole 194, the respective flexible corner arm 110 returns to its rest configuration as the notch 138 is aligned with the printed circuit board 190. In their rest configurations, the flexible corner arms 110 grip the printed circuit board 190 in the notches 138. Further, the shoulder 150 engages a surface of the printed circuit board 190 to grip the PCB 190 between the shoulder 150 and the tapered end 140.

The PCB mount 130 is thus configured to grip the printed circuit board 190, which maintains a desired alignment of the four corner arms 110 and the center conductor 112 relative to a plane of the PCB 190 before soldering the connector 100 to the PCB 190. Also, there is no need for a person doing the soldering to hold the connector 100 while soldering. As a result, a connector 100 according to various aspects of the disclosure makes the soldering process easier and quicker. The connector 100 may also provide better contact by maintaining the position of the corner arms 110 and the center conductor relative to the plane of the PCB 190 with the gripping performed by the PCB mount 130.

It should be appreciated that, in some embodiments, the connector 100 may be designed to be coupled with the printed circuit board 190 without soldering. For example, the flexible corner arms 110 and, in particular, the PCB mount 130 can be constructed so as to provide flexibility and a gripping force that ensure mechanical and electrical coupling of the connector 100 to the printed circuit board 190.

Additional embodiments include any one of the embodiments described above, where one or more of its components, functionalities or structures is interchanged with, replaced by or augmented by one or more of the components, functionalities or structures of a different embodiment described above.

It should be understood that various changes and modifications to the embodiments described herein will be apparent to those skilled in the art. Such changes and modifications can be made without departing from the spirit and scope of the present disclosure and without diminishing its intended advantages. It is therefore intended that such changes and modifications be covered by the appended claims.

Although several embodiments of the disclosure have been disclosed in the foregoing specification, it is understood by those skilled in the art that many modifications and other embodiments of the disclosure will come to mind to which the disclosure pertains, having the benefit of the teaching presented in the foregoing description and associated drawings. It is thus understood that the disclosure is not limited to the specific embodiments disclosed herein above, and that many modifications and other embodiments are intended to be included within the scope of the appended claims. Moreover, although specific terms are employed herein, as well as in the claims which follow, they are used only in a generic and descriptive sense, and not for the purposes of limiting the present disclosure, nor the claims which follow.

What is claimed is:

1. A printed circuit board connector, comprising:

a body member;

a cable attachment portion configured to be coupled with a cable; and a printed circuit board attachment section configured to be coupled with a printed circuit board, wherein the printed circuit board attachment section is configured to be coupled with the printed circuit board via a snap-fit connection, wherein the printed circuit board attachment section includes a center conductor and an outer conductor, the outer conductor including four corner arms, wherein each of the four corner arms includes a first portion having a first end at the body member and extending from the body member to a mount, wherein the mount includes a flange extending from a second end of the first portion in a direction away from the center conductor and a finger extending from the flange in a direction away from the body member, and wherein the finger of the mount has an outer surface that includes a notch extending along a length of the finger, the finger includes a tapered free end, and an inner surface of the finger cooperates with a surface of the flange that faces away from the body member to define a shoulder.

2. The printed circuit board connector of claim 1, wherein the printed circuit board attachment section is configured to couple the connector with electrical ground and signal traces of the printed circuit board.

3. The printed circuit board connector of claim 1, wherein the printed circuit board attachment section includes a pin that forms the center conductor.

4. The printed circuit board connector of claim 3, wherein the four corner arms and the center conductor are configured to be coupled with the printed circuit board, the printed circuit board having a hole pattern corresponding with the four corner arms and the center conductor.

5. The printed circuit board connector of claim 4, wherein the printed circuit board includes a center hole configured to receive the center conductor and four outer holes configured to receive the four corner arms.

6. The printed circuit board connector of claim 1, wherein the finger extends parallel to the center conductor.

7. The printed circuit board connector of claim 1, wherein the finger is axially offset from the first portion relative to an axis of the center conductor.

8. The printed circuit board connector of claim 1, wherein the outer surface of the finger faces in a direction away from the center conductor.

9. The printed circuit board connector of claim 1, wherein the four corner arms are flexible in a direction toward and away from the center conductor so as to function as a gripping assembly to couple the connector to the printed circuit board.

10. The printed circuit board connector of claim 9, wherein, as the four corner arms are inserted into corresponding holes in the printed circuit board, the four corner arms are urged inward in a direction toward the center conductor.

11. The printed circuit board connector of claim 10, wherein:

the four corner arms each include a tapered end and a notch adjacent the tapered end, and after the tapered end of each corner arm is inserted through the corresponding hole, the respective flexible corner arm is configured to return to a rest configuration as the notch is aligned with the printed circuit board.

12. The printed circuit board connector of claim 1, wherein the printed circuit board attachment section is configured to grip the printed circuit board, via the snap-fit connection, to maintain a desired alignment of the four corner arms and the center conductor relative to a plane of the printed circuit board.

13. The printed circuit board connector of claim 1, wherein the connector is one of a straight mount jack and a right angle jack.

14. The printed circuit board connector of claim 1, wherein the cable attachment portion is configured as one of an F-type connector and a BNC connector.

15. A connector configured to be coupled with a printed board, the connector comprising:

a body member;

a cable attachment portion configured to be coupled with a cable; and an attachment section configured to be coupled with the printed board, the attachment section including a center conductor and an outer conductor, the outer conductor including four corner arms, wherein the attachment section is configured to be coupled with the printed board via a snap-fit connection to maintain a desired alignment of the four corner arms and the center conductor relative to a plane of the printed board, wherein each of the four corner arms includes a first portion having a first end at the body member and extending from the body member to a mount, wherein the mount includes a flange extending from a second end of the first portion in a direction away from the center conductor and a finger extending from the flange in a direction away from the body member, and wherein the finger of the mount has an outer surface that includes a notch extending along a length of the finger, the finger includes a tapered free end, and an inner surface of the finger cooperates with a surface of the flange that faces away from the body member to define a shoulder.

16. The connector of claim 15, wherein the finger extends parallel to the center conductor and is axially offset from the first portion relative to an axis of the center conductor.

17. The connector of claim 15, wherein the finger faces in a direction away from the center conductor.

18. The connector of claim 15, wherein the four corner arms are configured to be flexible in a direction toward and away from the center conductor so as to function as a gripping assembly to couple the connector to the printed board.

19. The connector of claim 15, wherein the four corner arms and the center conductor are configured to be coupled with the printed board, the printed board having a hole pattern corresponding with the four corner arms and the center conductor.

20. A connector configured to be coupled with a printed board, the connector comprising:

a cable attachment portion configured to be coupled with a cable; and an attachment section configured to be coupled with the printed board, the attachment section including a center conductor and an outer conductor, the outer conductor including four corner arms, wherein the attachment section is configured to be coupled with the printed board via a snap-fit connection to maintain a desired alignment of the four corner arms and the center conductor relative to a plane of the printed board, wherein the four corner arms each include a tapered end and a notch adjacent the tapered end, wherein the four corner arms are configured to be urged inward in a direction toward the center conductor as the four corner arms are inserted into corresponding holes in the printed circuit board, and wherein, after the tapered end of each corner arm is inserted through the corresponding hole, the respective flexible corner arm is configured to return to a rest configuration as the notch is aligned with the printed board.

* * * * *